US007087029B2

(12) United States Patent
Friedland

(10) Patent No.: US 7,087,029 B2
(45) Date of Patent: Aug. 8, 2006

(54) MASSAGER

(76) Inventor: Frank Friedland, 19090 Two River La., Boca Raton, FL (US) 33498

( * ) Notice: Subject to any disclaimer, the term of this patent is extended or adjusted under 35 U.S.C. 154(b) by 0 days.

(21) Appl. No.: 10/678,970

(22) Filed: Oct. 2, 2003

(65) Prior Publication Data

US 2005/0075589 A1 Apr. 7, 2005

(51) Int. Cl.
*A61H 1/00* (2006.01)

(52) U.S. Cl. ..... 601/72; 601/80; 128/878; 128/879

(58) Field of Classification Search ..... 601/46, 601/48, 72–74, 80; 128/878–880; 602/20–23
See application file for complete search history.

(56) References Cited

U.S. PATENT DOCUMENTS 4,091,805 A * 5/1978 Clark ..... 601/80
4,106,500 A * 8/1978 Burchart ..... 601/72
5,016,617 A * 5/1991 Tarlow et al. ..... 601/117
5,113,849 A * 5/1992 Kuiken et al. ..... 601/40
6,656,139 B1 * 12/2003 Zwezdaryk ..... 601/46

* cited by examiner

*Primary Examiner*—Michael A. Brown
(74) *Attorney, Agent, or Firm*—Marten Fleit; Paul D. Bianco; Fleit Kain Gibbons Gutman Bongini & Bianco

(57) ABSTRACT

A massage device is composed of an elongated main body in the form of a sheet of flexible plastic material. The main body is configured with a plurality of flexible elongated strips extending from one end of the elongated body in cantilever fashion and juxtaposed spaced apart at their free ends to give the appearance of a hand with fingers splayed. The elongated strips define substantial contact areas, and an additional substantial contact area is defined at the other end of the main body. A vibration motor is fixed to the main body, which when operated imparts vibrations to the substantial contact areas via the main body to enable the device to perform a massage that simulates a hand massage.

11 Claims, 6 Drawing Sheets

MASSAGER

BACKGROUND OF THE INVENTION

1. Field of the Invention

The invention relates to a novel massager and more particular to a battery operated novel massager to simulate a hand massage.

2. Prior Art

Massaging the human body can be a valuable form of therapeutic relief. A professional is often employed to give a hand massage because of that person's knowledge of the muscles of the body and that person's ability to apply controlled pressure for some determined amount of time. It would be very desirable for a lay person, to have available an instrument, which, when used properly could achieve much of the same psychic and muscle tension relaxing results as a hand massage as given by a professional.

Electrically operated massagers, are generally known and available, but no known massagers exists for the purpose of giving a hand massage that simulates that given by a professional.

SUMMARY OF THE INVENTION

The present invention provides a novel massager that enables one to give himself/herself a massage that simulates a hand massage as given by a professional.

The foregoing advantage is achieved by the present invention by the provision of an instrument which is comprised of a main thin, flexible sheet of material, such as, polycarbonate, that has been molded to create a fanciful configuration of a hand with the fingers splayed, and the tips of the fingers serving to impart vibrations via the contact transfer areas. The rear area of the device, that is the portion corresponding to the heel of the hand, is also provided with contacting message areas. The tips are either bent ends or receptacles, so the instrument can be easily held in a hand and yet, the contact areas provided to effect massage are substantial. The device or instrument is battery operated and driven by a vibration motor. The bent ends or receptacles provide substantial contact surfaces from which the vibrations can be imparted to the body undergoing massage. In addition, in a preferred embodiment, a pair of receptacles or cans is molded at the rear of the sheet. The sheet is fancifully configured as a hand, and the transfer of the vibrations takes place at the equivalent of the fingertips, the thumb tip and the rear or heel of the palm of the hand.

More particularly, the present invention concerns a massage device comprising a main body in sheet form composed of a flexible plastic material and fancifully configured in the shape of a hand with fingers splayed by elongated portions extending from one end thereof, at least some of the elongated portions of the main sheet that project from one end thereof serving as fingers defining substantial contact areas for massage, and a vibration motor fixed to the main sheet for producing vibrations in the main sheet that are transmitted to the substantial contact areas for effecting a massage when the vibration motor is activated and the substantial contact areas are contacted with a person to be massaged.

The massage device according to the above may be configure such that the ends of the portions of the main body serving as fingers are bent downwardly at their ends and the substantial contact areas are defined at the tips of the bent downward ends. Also, the portions of the main body serving as fingers can have receptacles formed at their ends opening upwardly to receive the tips of fingers of a person holding the massage device. Still further, the portions of the main body serving as fingers can be curved downwardly.

The massage device according to the above can have the vibration motor is fixed to the top of the main body. Alternatively, the vibration motor can be fixed to the bottom of the main body. Also, the massage device can have a battery box mounted on the rear portion of the main body. In such an arrangement, leads connect the battery box and the vibration motor, and a switch is interposed in one of the leads to control the operation of the vibration motor. The massage device can have at least one substantial contact area defined at the rear end of the main body serving as a heel of the fanciful hand.

Summarizing, the massage device according to the invention comprises an elongated main body in the form of a sheet of flexible plastic material, the main body configured with a plurality of elongated strips extending from one end of the elongated body in cantilever fashion and juxtaposed spaced apart at their free ends to give the appearance of a hand with fingers splayed, the elongated strips defining substantial contact areas, an additional substantial contact area defined at the other end of the main body, and a vibration motor fixed to the main body, which when operated imparts vibrations to the substantial contact areas via the main body to enable the device to perform a massage that simulates a hand massage.

Other advantages and structural features of the invention will become more readily apparent from the following detailed description of the invention with reference to preferred embodiments when taken together with the drawings.

BRIEF DESCRIPTION OF THE DRAWINGS

A more complete understanding of the present invention, and the attendant advantages and features thereof, will now be explained in the following detailed description of preferred embodiments when taken in conjunction with the accompanying drawings wherein.

DETAILED DESCRIPTION OF PREFERRED EMBODIMENTS OF THE INVENTION

Figure 1:
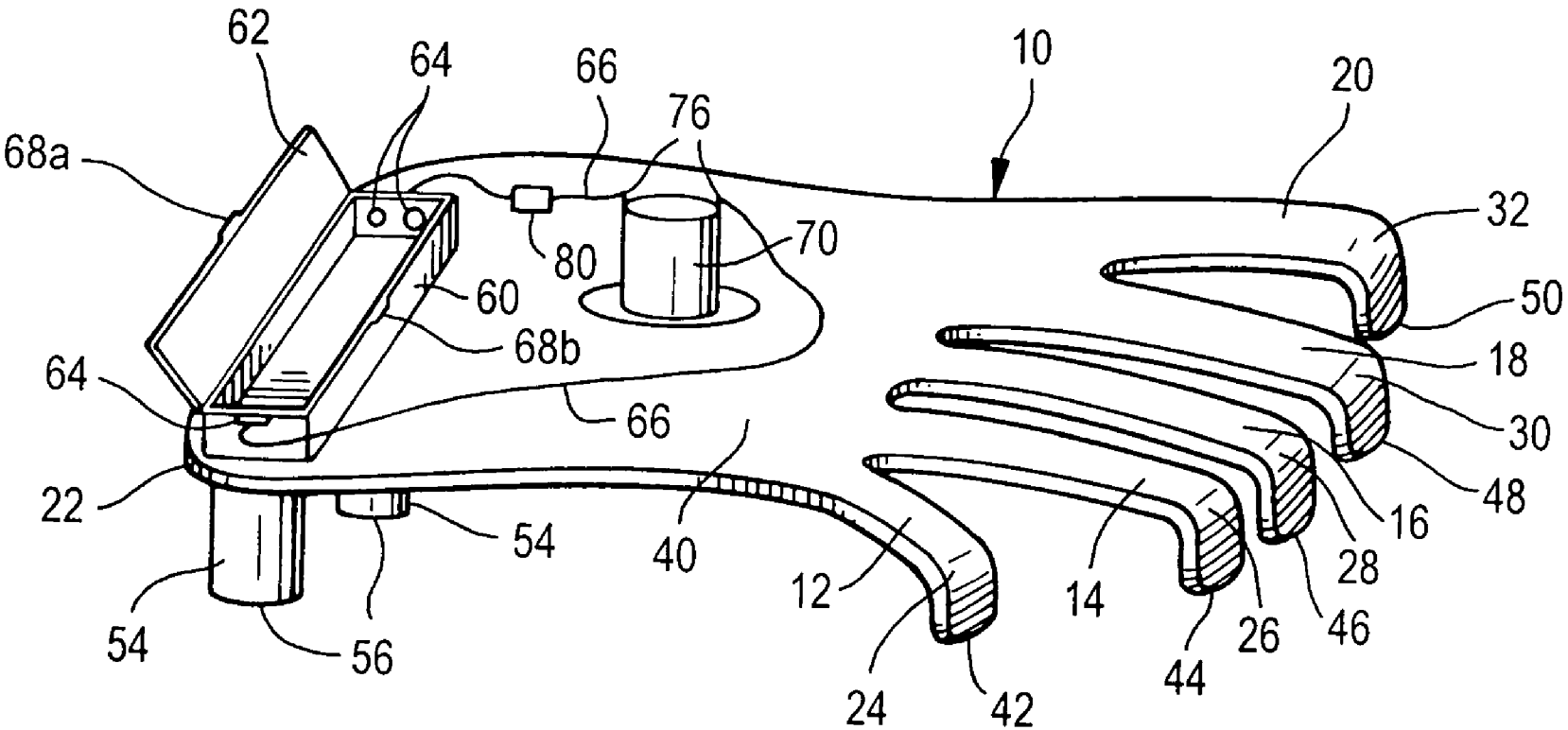
FIG. 1 is a top schematic view of a simple model of the novel massager of the present invention.
Figure 2:
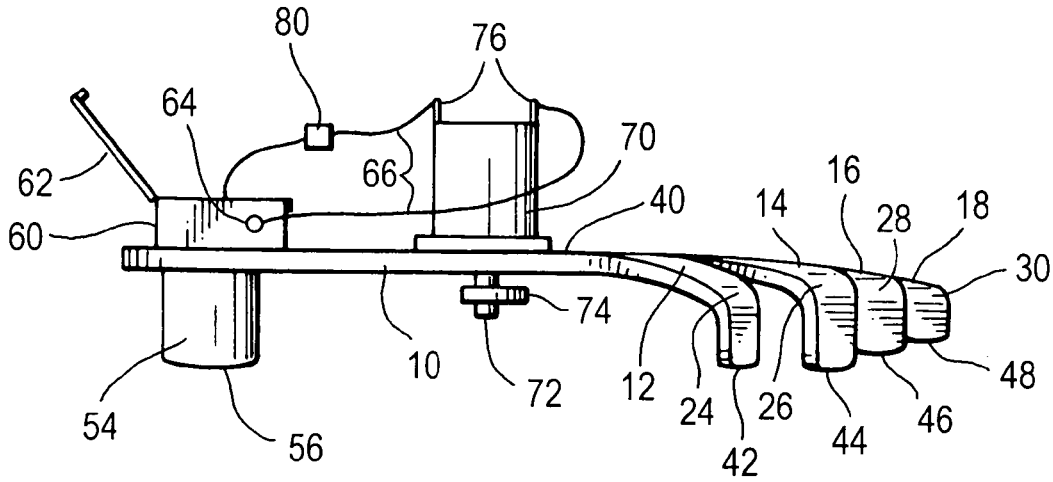
FIG. 2 is a side schematic view of the novel massager of the present invention as shown in FIG. 1.

Referring now to the drawings, FIGS. 1 and 2 illustrate a first embodiment of the invention. The novel massager consists of a relatively thin sheet 10, of a flexible plastic material, such as polycarbonate, that has been molded in the form of a fanciful configuration of a hand, having a heel portion 22 at one end and splayed thumb and fingers 12–20 at the other end representative of the digits of a hand, such as, a thumb (12) and four fingers (14–20). The digits or elongations (elongated plates) constituting the fingers 14–20 and the thumb 12 are flexible and cantilever out from the main portion 40 of the sheet 10 terminating in free ends and are downwardly curved at their extremities, terminating in bent portions 24–32, which are bent downwardly at a generally 90 degree angle with respect to the remainder of the elongations or digits. The extreme tips 42–50 of the bent portions 26–32 present flat substantial contact massage areas approximately from about 0.4 square centimeters to about 1 square centimeter, and even slightly larger depending on the thickness of the sheet 10, which is from about 0.2 cm to about 0.5 cm thick, but may be slightly thinner or thicker.

At the rear or heel portion 22 of sheet 10, a pair of spaced skirts 54 depend from the under surface of sheet 10, generally spaced transversely. The lower free ends 56 of skirts 54 provide flat substantial contact massage surfaces and have the same conformation as the free ends or tips 42–50, and the same areas. On the top surface of the sheet 10 at the rear 22 is fixed a battery box 60 with a hinged top 62 that is provided with an easily operable latching device 68*a*, 68*b* with the box 60 to be able to shut the box 60 when loaded with a pair of batteries (not shown), and to access the box 60 when necessary to change the batteries. The box 60 is provided with suitable contacts 64 to engage the batteries, and in turn, the contacts 64 are connected via wires 66 to the contacts 76 of a known conventional vibration motor 70 that is mounted on the top surface of the sheet 10, in the region designated as 40, with its shaft 72 and eccentric flywheel 74 protruding through an opening in the sheet 10. A switch 80 is interposed in one of the wires 66 to serve as an ON-OFF switch to enable manual control of the vibration motor 70. When motor 70 is operational, the vibration motor causes the sheet 10 and all parts molded integrally with or fixed to the sheet 10 to vibrate. By manipulating the novel massager manually, a hand massage can be simulated.

Figure 3:
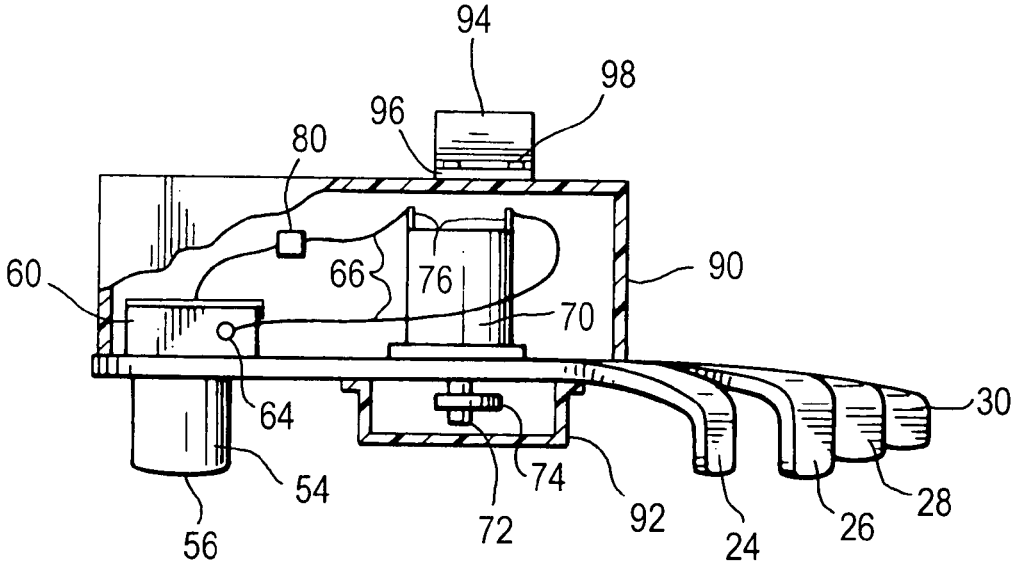
FIG. 3 is a side schematic view of the novel massager of the present invention as shown in FIG. 1 illustrating covers for the vibration motor.
Figure 4:
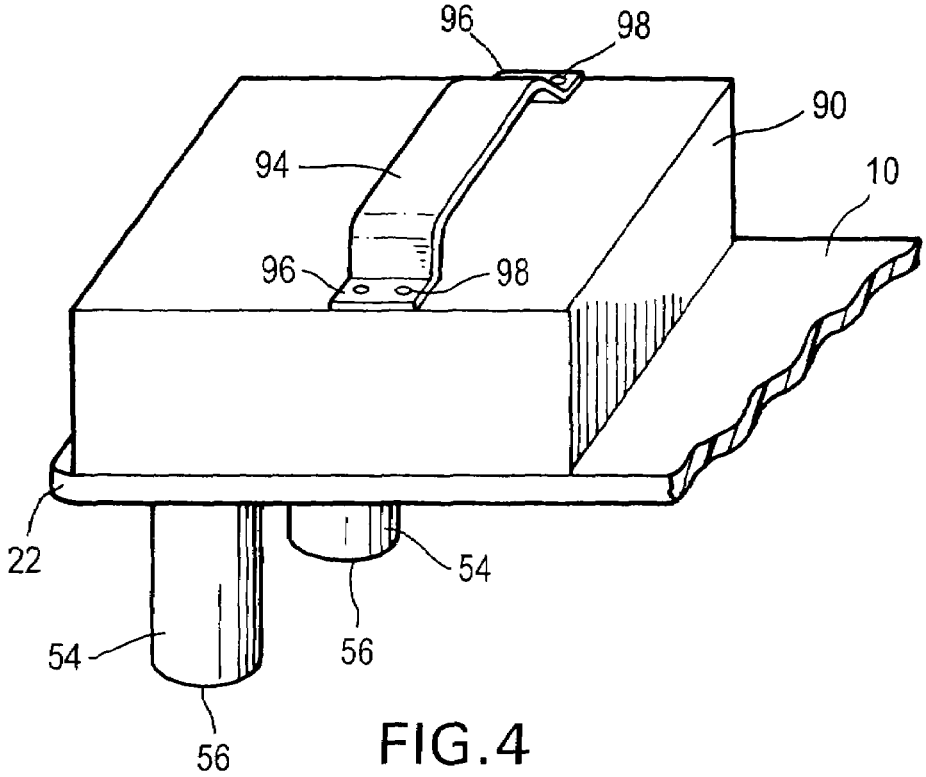
FIG. 4 is a partial schematic representation of the rear portion of the novel massager of the present invention illustrating a way to maintain the massager firmly on a hand.

FIGS. 3 and 4 illustrates the improvement of the battery box 60 and the vibration motor 70 being housed in a common protective housing 90 fixed to the upper surface of sheet 10. Fixing can be effected by any known means. Egress to the interior of housing 70 is not shown, but any known arrangement can be employed for this purpose and such known arrangements will readily be apparent to those of ordinary skill in the art. The protruding shaft 72 and eccentric flywheel 74 are likewise covered by a protective housing 92 fixed to the under surface of sheet 10. Housings 90 and 92 may be composed of plastic similar to sheet 10 to facilitate fixing. Transversely across the top of housing 90 is fixed a loop or strap 94. The fixing 98 is at the ends 96 by heat welding, sealing or the use of known fixing elements, such as, screws. The strap is looped to enable a person to slide his/her hand beneath the strap 94, so the fingers can reach the elongations 12–20 and the ends of the fingers can curl over the bent portions 24–32 to control the device during operation of the vibration motor. By these means, an effective simulation of a hand massage can be accomplished.

Figure 5:
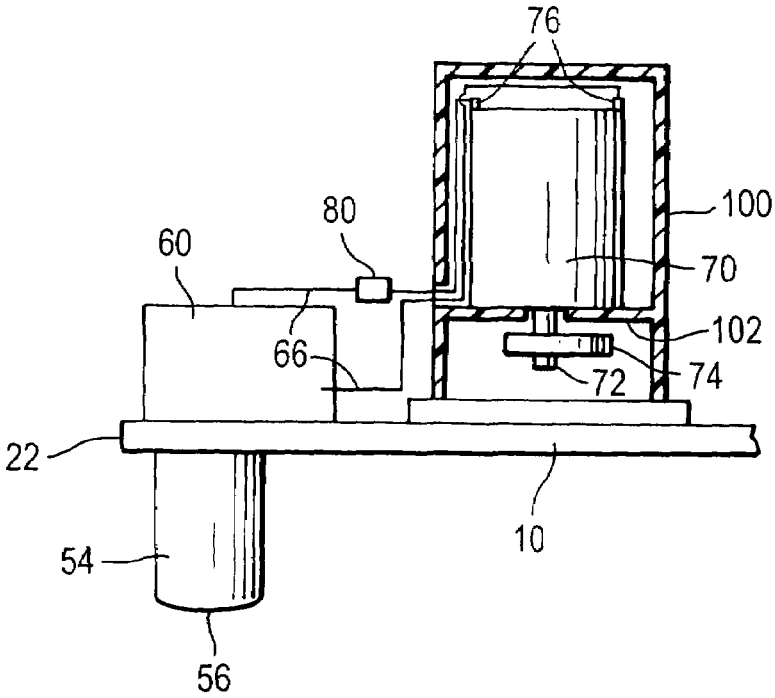
FIG. 5 is a partial side schematic view of the novel massager of the present invention illustrating a top mounting for the vibration motor.
Figure 6:
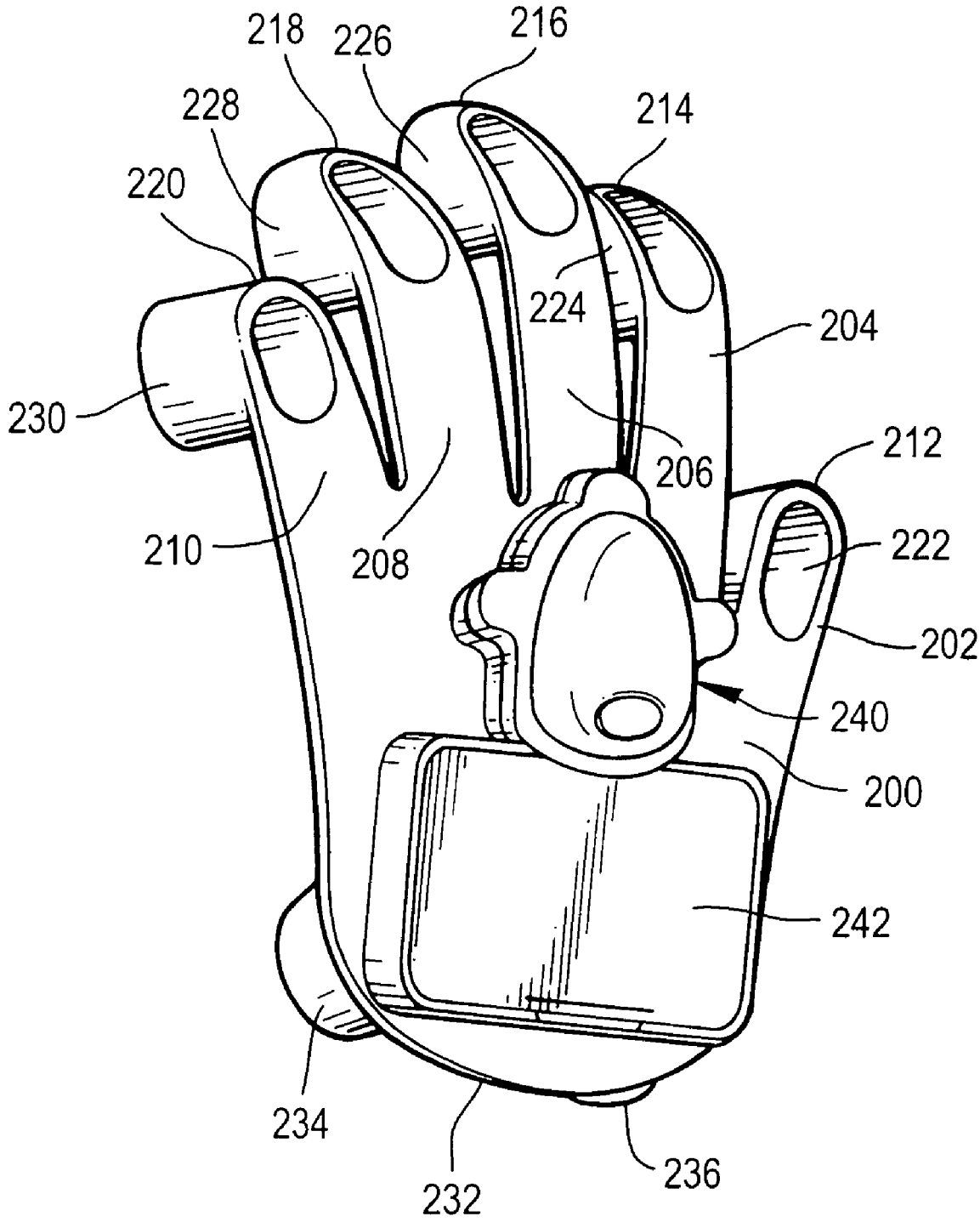
FIG. 6 is a top schematic view of a preferred embodiment of the novel massager of the present invention.
Figure 7:
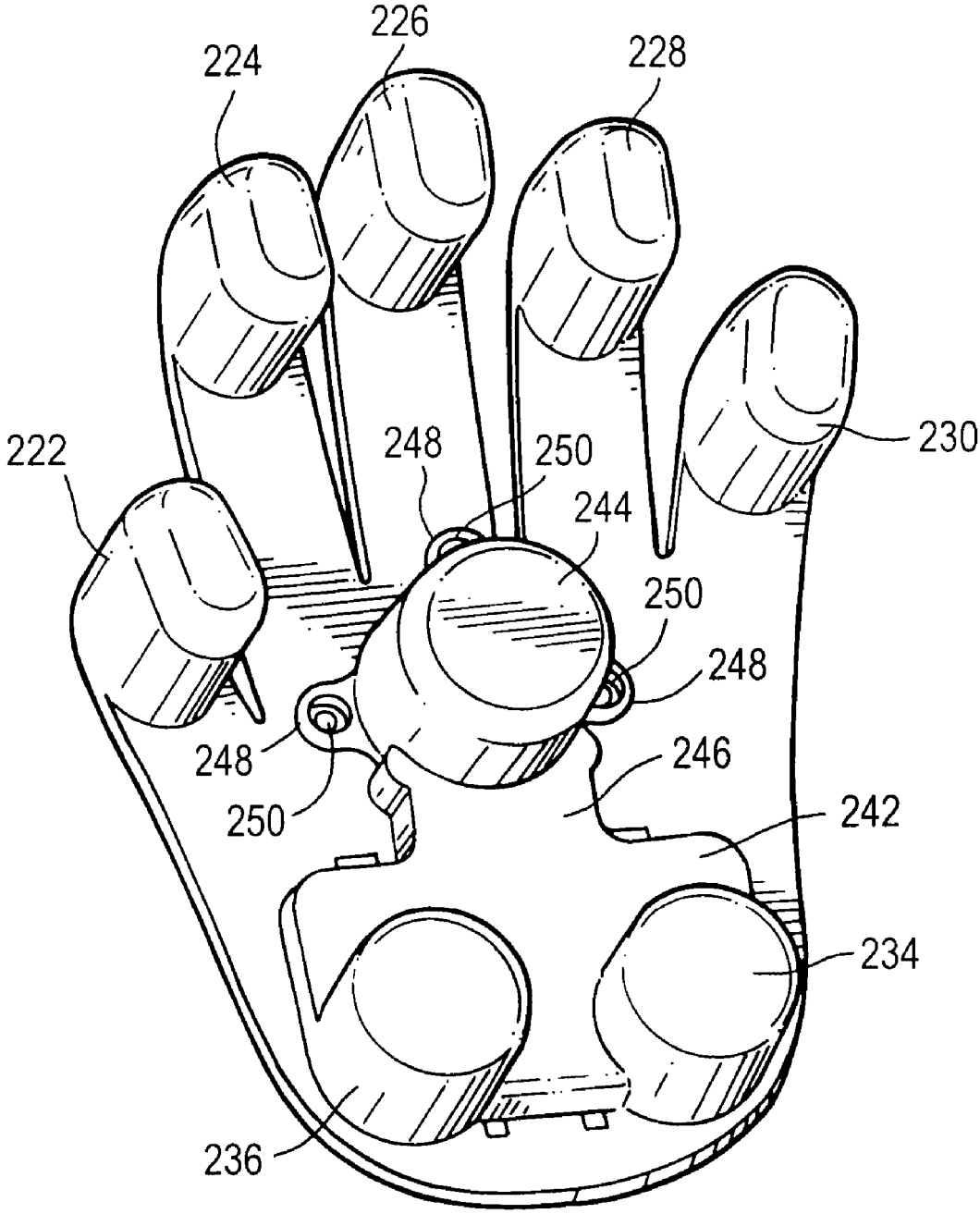
FIG. 7 is a bottom view of the preferred embodiment shown in FIG. 6.
Figure 8:
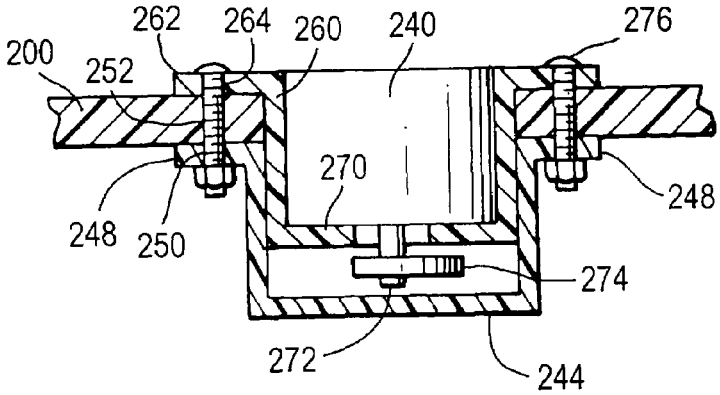
FIG. 8 is a detail in side elevations showing the vibration motor mount.

FIG. 5 illustrates an organization of the components of the novel massager so that the vibration motor and its parts are all positioned above the sheet 10. Illustrated is the rear or heel portion 22 of the sheet 10. The vibration motor 70 is mounted and fixed inside a housing 100 that provides an intermediate platform 102 for supporting motor 70 while allowing its shaft 72 and fixed eccentric 74 to pass through the platform 102 and still be held above the sheet 10. Housing 100 is fixed to the upper surface of sheet 10 as shown. Although the vibration motor 70 and its parts has been shown to be positioned above the sheet 10, it is equally feasible for the motor 70 to lie entirely below sheet 10, simply by inverting the housing 100 and fixing to the underneath surface of sheet 10.

Referring now to FIGS. 6 to 10, a particularly efficacious preferred embodiment is shown. This preferred embodiment consists of a plastic sheet 200, preferably a polycarbonate that is flexible, that is molded in the fanciful configuration of a hand with fingers (flexible elongated strips 202–210) splayed and curved downwardly toward their free ends or finger tips (212–220). At their ends 212–220, receptacles or cans 222–230 are integrally molded into which the user inserts his/her finger tips. At the rear or heel 232 of the fanciful hand or sheet 10, a pair of receptacles or cans 234, 236 are integrally molded to depend downwardly from the underneath surface of the sheet 10 at the heel 232. The bottoms of the receptacles 222–230 and 234 and 236 provide a large or substantial area that serves as a contact area with a person undergoing massage. This contact area can be from about 0.4 square cm to about 1 square cm, and may be slightly less or slightly greater.

As already discussed above, the novel massager is provided with a vibration motor, generally designated as 240, that is mounted or fixed to the sheet 200 to vibrate same, and a battery box 242 to hold batteries serving as the power supply for the vibration motor 240. As already noted, the vibration motor has an output shaft with an eccentric flywheel fixed to the shaft. In the design shown, the shaft protrudes through sheet 200 and is covered by a cover 244. A molded plate 246 including cover 244 is fixed to the bottom surface of sheet 200 and provided three lugs 248 each having an opening 250 registering with openings 252 in the sheet 200. The battery box 242 protrudes slightly below sheet 200 and receptacles or cans 234 and 236 are integrally molded with the box 242. A housing 260 is used to mount the vibration motor 240 in the sheet 200. Housing 260 is provided with tabs or lugs 262 with openings 264 registering with the openings 250 and 252, see FIG. 8, in particular. The vibration motor 240 is mounted in the housing 260 and supported by a platform 270. The output shaft 272 of motor 240 protrudes through the platform 270 into the space provided by cover 244. Eccentric flywheel 274 is fixed to shaft 272. Fasteners, such as nut and bolts assemblies 276 secure the housing 260 and cover 244 to the sheet 200.

Figure 9:
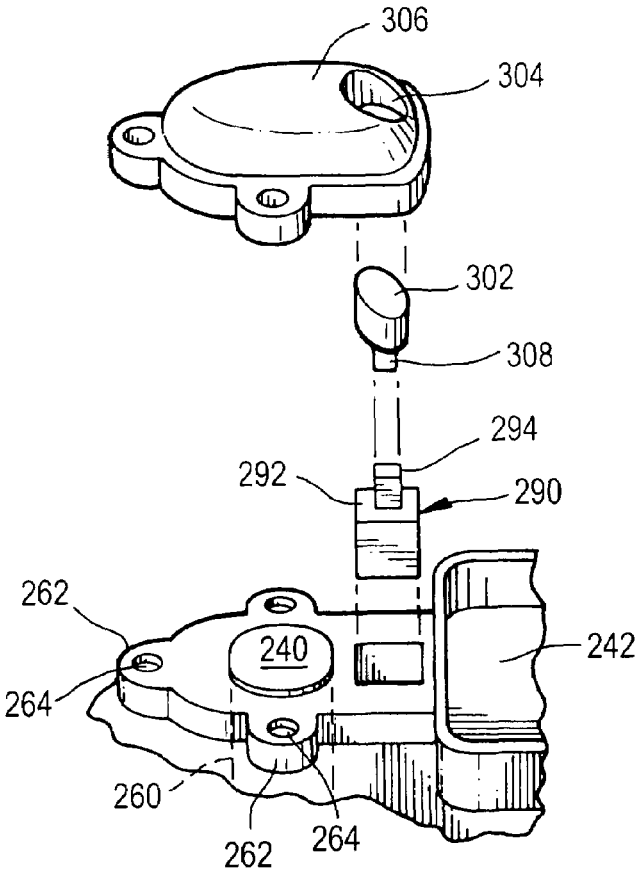
FIG. 9 is a detail in side elevation showing in an exploded view the switch mounting for controlling the vibration motor.
Figure 10:
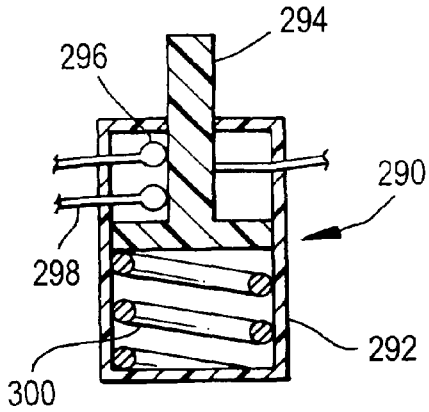
FIG. 10 is a detail showing the internal operation of the switch.

Referring now to FIG. 9, an exploded view is illustrated of the assembly of the cover 280 for the top of the vibration motor 240 assembly, the battery box, and the control ON-OFF switch 290. The control switch 290 is shown in detail in FIG. 10, and consists of a housing 292 within which a plunger 294 makes or breaks contact 296 for one of the power lines 298 leading from the batteries to the vibration motor 240. A spring 300 provides a restoring force within the switch to maintain the repose condition as non-contacting. An actuator element consisting of an actuating plug 302 is held in loose engagement in an opening 304 defined in a cover plate 306. A rod 308 depends from the plug 302 and engages the top of plunger 294. When the plug 302 is depressed downward, the rod 308 forces the plunger 294 down to make contact and complete the circuit from the batteries to the vibration motor 240, thereby driving the motor 240 and producing vibrations.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A massage device comprising:

(a) an elongated main body composed of a thin flat flexible molded plastic sheet having upper and tower surfaces;

(b) said elongated main body being molded into a fancifully configuration in the outline of a hand having a first end portion of the elongated main body constituting the heel of the hand, and having a second end portion of the elongated main body formed with a plurality of first elongated thin flexible strips, (c) each said strip at one end being integral with the main body and being cantilevered in a longitudinal direction away from the main body and terminating in a free end, the extreme tip of which defines a fiat substantial contact massage surface extending transversely;

(d) the first elongated strips at their free ends being spaced apart to simulate fingers splayed;

(e) a second elongated strip integral with the main body extending from one side of the main body cantilevered at an angle to simulate a thumb and terminating in a free end, the extreme tip of which defines a fiat substantial contact massage surface extending transversely;

(f) the first and second elongated strips being curved slightly downwardly and at their free ends depending downwardly at an angle so that the extreme tips with the flat substantial contact massage surfaces face downwardly;

(g) a projection, integrally molded with the elongated main body, projecting downwardly from the lower surface of the elongated main body adjacent the first end of the elongated main body and terminating in a free end having a flat substantial contact surface facing downwardly; and (h) a battery-operated vibration motor mounted on the elongated main body to induce vibrations in said main body, for transmission to the substantial contact surfaces.

2. A massage device according to claim 1, wherein the thin flexible plastic sheet is composed of polycarbonate.

3. A massage device according to claim 1, wherein the extreme tips with the flat substantial contact massage surfaces at the free ends of the first and second elongated ships each have an area of at least 0.4 square centimeters.

4. A massage device according to claim 2, wherein the thin flexible plastic sheet is from about 0.2 to about 0.5 centimeters thick.

5. A massage device according to claim 1, wherein the first elongated strips at their free ends are bent or curved downwardly.

6. A massage device according to claim 1, wherein the free ends of the first elongated strips are integrally molded in the form of open top receptacles.

7. A massage device according to claim 1, wherein two laterally spaced projections are integrally molded with the elongated main body projecting downwardly from the lower surface of the elongated main body adjacent the first end of the elongated main body and terminating in free ends having substantial contact surfaces facing downwardly.

8. A massage device according to claim 1, wherein a strap is fastened at its ends transversely across the elongated main body on its upper surface, with the central portion of the strap looped to enable a hand to pass under the strap.

9. A massage device according to claim 1, wherein a battery box is fixed to the elongated main body and electrical connections including an on-off switch interconnect the battery box and the battery-operated vibration motor.

10. A massage device according to claim 9, wherein an enclosure is fixed to the elongated main body that encloses the battery box and the battery-operated vibration motor.

11. A massage device according to claim 10, wherein a strap is fastened at its ends transversely across the enclosure, with the central portion of the strap looped to enable a hand to pass under the strap.

* * * * *